US008943709B2

(12) United States Patent
Aveni et al.

(10) Patent No.: US 8,943,709 B2
(45) Date of Patent: Feb. 3, 2015

(54) ARTICLE OF FOOTWEAR WITH SUPPORT COLUMNS HAVING FLUID-FILLED BLADDERS

(75) Inventors: Michael A. Aveni, Lake Oswego, OR (US); Thomas McGuirk, Lake Oswego, OR (US); Danielle L. Taylor, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1327 days.

(21) Appl. No.: 12/265,881

(22) Filed: Nov. 6, 2008

(65) Prior Publication Data

US 2010/0107444 A1 May 6, 2010

(51) Int. Cl.

*A43B 21/28* (2006.01)
*A43B 13/20* (2006.01)
*A43B 13/18* (2006.01)

(52) U.S. Cl.

CPC ..... *A43B 13/206* (2013.01); *A43B 13/20* (2013.01); *A43B 13/189* (2013.01); *A43B 21/28* (2013.01)
USPC ..... 36/35 B; 36/29

(58) Field of Classification Search

CPC ..... A43B 13/18; A43B 13/20; A43B 13/189; A43B 21/28
USPC ..... 36/27, 28, 29, 35 R, 35 B, 37
See application file for complete search history.

(56) References Cited

U.S. PATENT DOCUMENTS 4,183,156 A 1/1980 Rudy
4,219,945 A 9/1980 Rudy
4,340,626 A 7/1982 Rudy
4,486,964 A 12/1984 Rudy
4,506,460 A 3/1985 Rudy
4,779,359 A 10/1988 Famolare, Jr.
4,906,502 A 3/1990 Rudy
4,936,029 A 6/1990 Rudy
4,999,931 A 3/1991 Vermeulen
5,042,176 A 8/1991 Rudy
5,083,361 A 1/1992 Rudy
5,220,737 A 6/1993 Edington
5,543,194 A 8/1996 Rudy
5,686,167 A 11/1997 Rudy
5,713,141 A 2/1998 Mitchell et al.
5,741,568 A 4/1998 Rudy
5,753,061 A 5/1998 Rudy (Continued)

FOREIGN PATENT DOCUMENTS

GB 2206475 A 1/1989
WO 2009067424 A2 5/2009

OTHER PUBLICATIONS

International Preliminary Report on Patentability issued May 19, 2011 in corresponding PCT Application No. PCT/US2009/063190.

(Continued)

*Primary Examiner* — Khoa Huynh
*Assistant Examiner* — Sharon M Prange
(74) *Attorney, Agent, or Firm* — Banner & Witcoff, Ltd.

(57) ABSTRACT

An article of footwear includes an upper and a sole assembly secured to the upper. The sole assembly has a top plate and a bottom plate positioned below the top plate. A plurality of support columns extends between the top plate and the bottom plate, with each support column formed of a plurality of fluid-filled bladders. Each bladder has a first surface, an opposed second surface, and a tensile member joined to the first and second surfaces.

18 Claims, 3 Drawing Sheets

(56) References Cited

U.S. PATENT DOCUMENTS

| | | | | |
|---|---|---|---|---|
| 5,916,664 | A | 6/1999 | Rudy | |
| 5,952,065 | A | 9/1999 | Mitchell et al. | |
| 5,993,585 | A | 11/1999 | Goodwin et al. | |
| 6,013,340 | A | 1/2000 | Bonk et al. | |
| 6,029,962 | A * | 2/2000 | Shorten et al. | 267/145 |
| 6,082,025 | A | 7/2000 | Bonk et al. | |
| 6,119,371 | A | 9/2000 | Goodwin et al. | |
| 6,127,010 | A | 10/2000 | Rudy | |
| 6,127,026 | A | 10/2000 | Bonk et al. | |
| 6,158,149 | A | 12/2000 | Rudy | |
| 6,203,868 | B1 | 3/2001 | Bonk et al. | |
| 6,321,465 | B1 | 11/2001 | Bonk et al. | |
| 6,457,263 | B1 | 10/2002 | Rudy | |
| 6,487,796 | B1 | 12/2002 | Avar et al. | |
| 6,665,958 | B2 | 12/2003 | Goodwin | |
| 6,837,951 | B2 | 1/2005 | Rapaport | |
| 6,898,870 | B1 | 5/2005 | Rohde | |
| 6,944,973 | B2 | 9/2005 | Goodwin | |
| 6,964,120 | B2 | 11/2005 | Cartier et al. | |
| 6,968,636 | B2 * | 11/2005 | Aveni et al. | 36/28 |
| 7,070,845 | B2 | 7/2006 | Thomas et al. | |
| 7,076,891 | B2 | 7/2006 | Goodwin | |
| 7,086,179 | B2 | 8/2006 | Dojan et al. | |
| 7,086,180 | B2 | 8/2006 | Dojan et al. | |
| 7,100,310 | B2 | 9/2006 | Foxen et al. | |
| 7,131,218 | B2 | 11/2006 | Schindler | |
| 7,141,131 | B2 | 11/2006 | Foxen et al. | |
| 7,314,125 | B2 | 1/2008 | Smaldone et al. | |
| 7,360,324 | B2 | 4/2008 | Aveni | |
| 7,458,172 | B2 | 12/2008 | Aveni | |
| 7,484,317 | B2 * | 2/2009 | Kita et al. | 36/27 |
| 7,685,742 | B2 | 3/2010 | Aveni et al. | |
| 7,730,635 | B2 | 6/2010 | Aveni et al. | |
| 7,757,410 | B2 | 7/2010 | Aveni et al. | |
| 7,802,378 | B2 | 9/2010 | Harmon Weiss et al. | |
| 2003/0051373 | A1 | 3/2003 | Goodwin | |
| 2005/0167029 | A1 | 8/2005 | Rapaport et al. | |
| 2006/0112592 | A1 | 6/2006 | Leedy et al. | |
| 2006/0130365 | A1 | 6/2006 | Sokolowski et al. | |
| 2007/0063368 | A1 | 3/2007 | Schindler | |
| 2007/0074423 | A1 | 4/2007 | Goodwin et al. | |
| 2007/0119074 | A1 | 5/2007 | Aveni et al. | |
| 2007/0193065 | A1 * | 8/2007 | Nishiwaki et al. | 36/27 |
| 2007/0266592 | A1 | 11/2007 | Smith et al. | |
| 2008/0016719 | A1 | 1/2008 | Aveni et al. | |
| 2008/0016720 | A1 | 1/2008 | Aveni et al. | |
| 2008/0034615 | A1 | 2/2008 | Nishiwaki | |
| 2008/0098619 | A1 | 5/2008 | Smaldone et al. | |
| 2009/0100705 | A1 | 4/2009 | Cook et al. | |
| 2009/0165333 | A1 * | 7/2009 | Litchfield et al. | 36/88 |

OTHER PUBLICATIONS

International Preliminary Report on Patentability issued May 19, 2011 in corresponding PCT Application No. PCT/US2009/063195.

International Search Report and Written Opinion issued Mar. 4, 2010 in corresponding PCT Application No. PCT/US2009/063190.

International Search Report and Written Opinion issued Mar. 4, 2010 in corresponding PCT Application No. PCT/US2009/063195.

Office Action issued Aug. 5, 2011 in related U.S. Appl. No. 12/265,878.

Office Action issued Dec. 23, 2011 in Chinese Patent Application No. 200980143905.1, and English translation thereof.

* cited by examiner

ARTICLE OF FOOTWEAR WITH SUPPORT COLUMNS HAVING FLUID-FILLED BLADDERS

FIELD OF THE INVENTION

This invention relates generally to footwear, and, in particular, to footwear having support columns that include fluid-filled bladders.

BACKGROUND OF THE INVENTION

Conventional articles of athletic footwear include two primary elements, an upper and a sole structure. The upper provides a covering for the foot that comfortably receives and securely positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces, the sole structure may provide traction, control foot motions (e.g., by resisting over pronation), and impart stability, for example. Accordingly, the upper and the sole structure operate cooperatively to provide a comfortable structure that is suited for a wide variety of activities, such as walking and running.

The sole structure generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole structure and is primarily responsible for attenuating ground reaction forces. The outsole forms the ground-contacting element of footwear and is usually fashioned from a durable, wear-resistant material that includes texturing to improve traction.

The conventional midsole is primarily formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators.

It would be desirable to provide an article of footwear with support columns that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide footwear having improved support columns that include fluid-filled bladders. In accordance with a first aspect, an article of footwear includes an upper and a sole assembly secured to the upper. The sole assembly has a top plate and a bottom plate positioned below the top plate. A plurality of support columns extends between the top plate and the bottom plate, with each support column formed of a plurality of fluid-filled bladders. Each bladder has a first surface, an opposed second surface, and a tensile member joined to the first and second surfaces.

In accordance with another aspect, an article of footwear includes an upper and a sole assembly secured to the upper. The sole assembly includes a midsole, a plate positioned below the midsole, and a plurality of support columns extending between the upper plate and the midsole. Each support column is formed of a plurality of fluid-filled bladders, with each bladder having a first surface, an opposed second surface, a sidewall joining the first surface to the second surface. The sidewall is formed of a plurality of first panels having a first thickness and a plurality of panels having a second thickness that is different from the first thickness, the first and second panels alternating about a periphery of the bladder, and a tensile member joined to the first and second surfaces. The tensile member includes a first wall bonded to the first surface, a second wall bonded to the second surface, and a plurality of connecting members extending between the first wall and the second wall.

In accordance with a further aspect, an article of footwear includes an upper and a sole assembly secured to the upper. The sole assembly includes a midsole, a plate positioned below the midsole, and a plurality of support columns extending between the upper plate and the midsole. Each support column includes a plurality of bladders filled with pressurized fluid, each bladder having a first surface, and an opposed second surface. A sidewall joins the first surface to the second surface, the sidewall being formed of a plurality of first panels having a first thickness and a plurality of panels having a second thickness that is different from the first thickness, the thickness of each panel varying from a maximum thickness at its central portion to reduced thickness portions where the sidewall joins the first and second surfaces, the first and second panels alternating about a periphery of the bladder. A tensile member is formed of a textile material and is joined to the first and second surfaces. The tensile member includes a first wall bonded to the first surface, a second wall bonded to the second surface, and a plurality of connecting members extending between the first wall and the second wall. An outsole is secured to at least one of the support assemblies.

Substantial advantage is achieved by providing footwear having support columns that include fluid-filled bladders. In particular, certain embodiments provide improved impact attenuation for the user.

These and additional features and advantages disclosed here will be further understood from the following detailed disclosure of certain embodiments.

Figure 1:
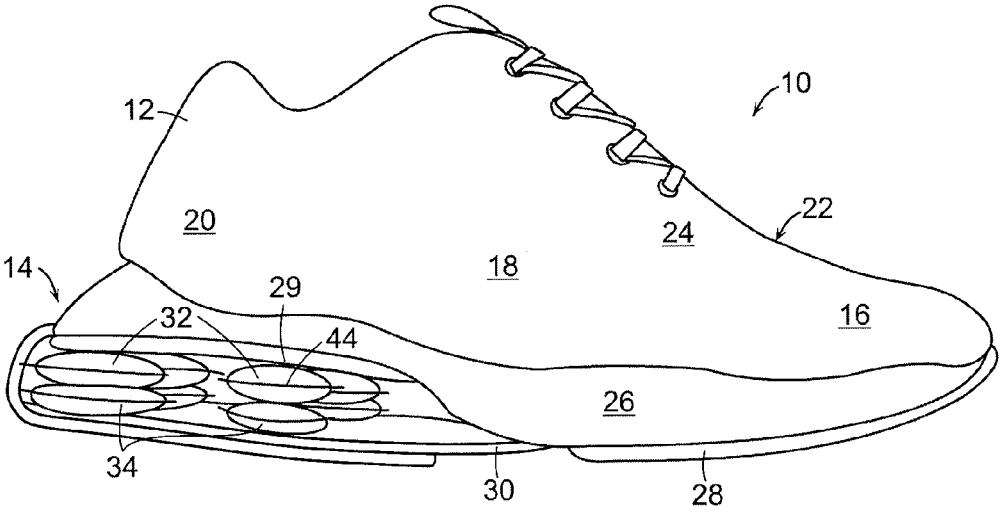
FIG. 1 is a perspective view of an article of footwear with a plurality of support columns having fluid-filled bladders.

The figures referred to above are not drawn necessarily to scale, should be understood to provide a representation of particular embodiments of the invention, and are merely conceptual in nature and illustrative of the principles involved. Some features of the article of footwear with support columns depicted in the drawings have been enlarged or distorted relative to others to facilitate explanation and understanding. The same reference numbers are used in the drawings for similar or identical components and features shown in various alternative embodiments. Articles of footwear with support columns as disclosed herein would have configurations and components determined, in part, by the intended application and environment in which they are used.

DETAILED DESCRIPTION OF CERTAIN PREFERRED EMBODIMENTS

The following discussion and accompanying figures disclose various embodiments of a sole structure for an article of footwear. The sole structure may be applied to a wide range of athletic footwear styles, including tennis shoes, football shoes, cross-training shoes, walking shoes, soccer shoes, and hiking boots, for example. The sole structure may also be applied to footwear styles that are generally considered to be non-athletic, including dress shoes, loafers, sandals, and work boots. An individual skilled in the relevant art will appreciate, therefore, that the concepts disclosed herein apply to a wide variety of footwear styles, in addition to the specific style discussed in the following material and depicted in the accompanying figures.

Figure 2:
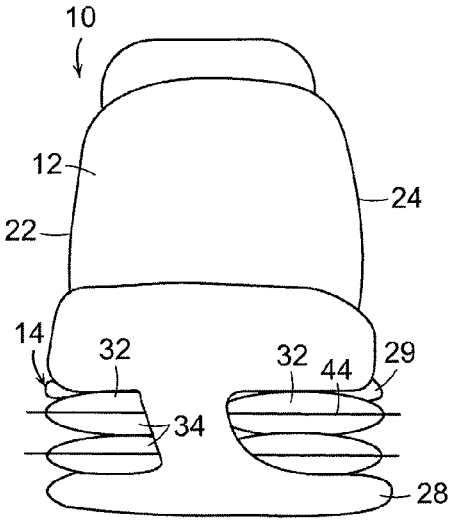
FIG. 2 is a rear elevation view of the article of footwear of FIG. 1.

An article of footwear 10 is depicted in FIGS. 1-2 as including an upper 12 and a sole assembly 14. For reference purposes, footwear 10 may be divided into three general portions: a forefoot portion 16, a midfoot portion 18, and a heel portion 20, as shown in FIGS. 1 and 2. Footwear 10 also includes a lateral side 22 and a medial side 24. Forefoot portion 16 generally includes portions of footwear 10 corresponding with the toes and the joints connecting the metatarsals with the phalanges. Midfoot portion 18 generally includes portions of footwear 10 corresponding with the arch area of the foot, and heel portion 20 corresponds with rear portions of the foot, including the calcaneus bone. Lateral side 22 and medial side 24 extend through each of portions 16-20 and correspond with opposite sides of footwear 10.

Portions 16-20 and sides 22-24 are not intended to demarcate precise areas of footwear 10. Rather, portions 16-20 and sides 22-24 are intended to represent general areas of footwear 10 to aid in the following discussion. In addition to footwear 10, portions 16-20 and sides 22-24 may also be applied to upper 12, sole assembly 14, and individual elements thereof.

The figures illustrate only the article of footwear intended for use on the left foot of a wearer. One skilled in the art will recognize that a right article of footwear, such article being the mirror image of the left, is intended to fall within the scope of the present invention.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the left as seen in FIG. 1. Naturally, forwardly is toward forefoot portion 16, that is, to the right seen in FIG. 1, and downwardly is toward the bottom of the page as seen in FIG. 1. Inwardly is toward the center of footwear 10, and outwardly is toward the outer peripheral edge of footwear 10.

Upper 12 forms an interior void that comfortably receives a foot and secures the position of the foot relative to sole assembly 14. The configuration of upper 12, as depicted, is suitable for use during athletic activities that involve running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Sole assembly 14 may be secured to upper 12 by an adhesive, or any other suitable fastening means. Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 includes an insole (not shown) located within upper 12, a midsole 26, and an outsole 28. Midsole 26 is attached to upper 12 and functions as the primary shock-attenuating and energy-absorbing component of footwear 10. Outsole 28 is attached to the lower surface of midsole 26 by adhesive or other suitable means. Suitable materials for outsole 28 include traditional rubber materials. Other suitable materials for outsole 28 will become readily apparent to those skilled in the art, given the benefit of this disclosure. In certain embodiments, sole assembly 14 may not include an outsole layer separate from midsole 26 but, rather, the outsole may comprise a bottom surface of midsole 26 that provides the external traction surface of sole assembly 14.

Sole assembly 14 includes a top plate 29 positioned beneath midsole 26 and a bottom plate 30 positioned beneath top plate 29. In the illustrated embodiment, top plate 29 extends beneath heel portion 20 of midsole 26, and bottom plate 30 extends rearwardly from a midfoot portion 18 of midsole 26 to a rear end of heel portion 20. Top plate 29 and bottom plate 30 can be formed of any desired material. Suitable materials include plastics, elastomers, carbon-filled materials, a polyether block copolyamide (sold as Pebax® by ATOFINA Chemicals of Philadelphia, Pa.), a blend of a polyether block copolyamide with another material (such as glass-filled nylon, carbon-filled materials, polyamides, or polyparaphenylene terephthalamides), thermoplastic polyurethane (TPU), or other materials. Other suitable materials for top plate 29 and bottom plate 30 will become readily apparent to those skilled in the art, given the benefit of this disclosure.

A plurality of support columns 32 is positioned between top plate 29 and bottom plate 30. Each support column 32 is formed of a plurality of fluid-filled bladders 34. In the illustrated embodiments, each support column 32 includes two bladders 34. It is to be appreciated that one or more support column 32 may include more than two bladders 34.

Figure 3:
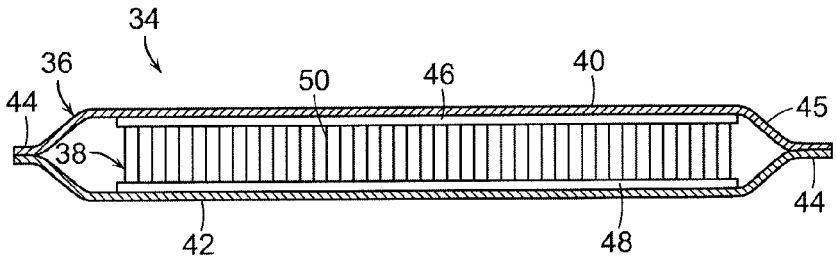
FIG. 3 is a sectional view of a fluid-filled bladder of the article of footwear of FIG. 1.

Each bladder 34 is a sealed member that encloses a pressurized fluid, as depicted in FIG. 3. Bladder 34 includes an outer barrier 36 and a tensile member 38 enclosed within outer barrier 36. Outer barrier 36 may be formed of a polymer material and includes a first barrier layer 40 and an opposite second barrier layer 42, each of which is substantially impermeable to the fluid within bladder 34. First barrier layer 40 and second barrier layer 42 are bonded together around their respective peripheries to form a peripheral bond 44 and cooperatively form a sealed chamber, in which the pressurized fluid is located. First barrier layer 40 forms an upper surface and a portion of a sidewall 45 of bladder 34, and second barrier layer 42 forms a lower surface and another portion of sidewall 45 of bladder 34. This configuration positions peripheral bond 44 at a midpoint of sidewall 45. Alternately, peripheral bond 44 may be positioned adjacent to the lower surface or the upper surface to promote visibility through sidewall 45. Accordingly, the specific configuration of outer barrier 36 may vary significantly within the scope of the present invention.

Support columns 32 provide a low profile and resilient support structure for footwear 10. Support columns can be used in place of many support structures in order to provide a lower profile, yet resilient support structure. For example, support columns 32 can be used in place of support structures found in footwear such as spring members, elastomeric support columns, impact-attenuating elements/members, support elements, and other elements that provide support in footwear. Exemplary structures for which support columns 32 can be substituted are found in U.S. Pat. Nos. 7,314,125; 6,898,870; and 6,964,120; and U.S. patent application Ser. Nos. 11/966,513; 11/459,180; 11/459,093; 11/422,138; 11/419,015; 11/287,474; 10/949,813; 10/926,080; and 09/754,022; each of which is incorporated herein in its entirety for all purposes.

It is to be appreciated that each bladder 34 may have one or more properties that are different from one or more properties of some or all of the other bladders 34. For example, the geometry of the bladders 34 may differ with respect to some or all of the other bladders 34. In certain embodiments, the height, or circumference, or diameter (or all three parameters) of any particular bladder 34 may be different than one or more other bladders 34. The pressure within bladders 34 can vary as well, and can be altered dependent on usage or needs; for example, certain types of footwear with high impact uses such as basketball and running footwear may have a higher pressure within its bladders 34 than footwear with lower impact uses such as walking or golf footwear. In other embodiments, the pressure within one or more bladders 34 can be adjusted to have a value different than that of one or more other bladders 34. Thus, in certain embodiments, the bladders 34 that form a particular support column 32 could be identical with one another, yet have one or properties that are different from other bladders 34 in other support columns 32. In other embodiments the bladders 34 in a particular support column 32 may be different, thereby allowing, for example, an upper bladder 34 to be softer than a harder lower bladder 34 in the support column, which can enhance performance and comfort in particular situations. In this manner, the performance and comfort of sole assembly 14 and, therefore, footwear 10 can be optimized for an individual or for a particular activity, for example.

A variety of thermoplastic polymer materials may be utilized for bladder 34, including polyurethane, polyester, polyester polyurethane, and polyether polyurethane. Another suitable material for bladder 34 is a film formed from alternating layers of thermoplastic polyurethane and ethylene-vinyl alcohol copolymer, as disclosed in U.S. Pat. Nos. 5,713,141 and 5,952,065 to Mitchell et al, hereby incorporated by reference. A variation upon this material wherein the center layer is formed of ethylene-vinyl alcohol copolymer; the two layers adjacent to the center layer are formed of thermoplastic polyurethane; and the outer layers are formed of a regrind material of thermoplastic polyurethane and ethylene-vinyl alcohol copolymer may also be utilized. Bladder 34 may also be formed from a flexible microlayer membrane that includes alternating layers of a gas barrier material and an elastomeric material, as disclosed in U.S. Pat. Nos. 6,082,025 and 6,127,026 to Bonk et al., both hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Additional suitable materials are disclosed in U.S. Pat. Nos. 4,183,156 and 4,219,945 to Rudy, hereby incorporated by reference. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., also hereby incorporated by reference.

The fluid within bladder 34 may be any of the gasses disclosed in U.S. Pat. No. 4,340,626 to Rudy, hereby incorporated by reference, such as hexafluoroethane and sulfur hexafluoride, for example. The fluid may also include gasses such as pressurized octafluorapropane, nitrogen, or air. In addition to gasses, various gels or liquids may be sealed within bladder 34. Accordingly, a variety of fluids are suitable for bladder 34. With regard to pressure, a suitable fluid pressure is 20 pounds per square inch, but may range from one to thirty-five pounds per square inch. Accordingly, the fluid pressure within bladder 34 may be relatively high, or the fluid pressure may be slightly elevated from ambient in some embodiments of the invention. As noted above, the pressure in one bladder 34 may be different than the pressure in one or more other bladders 34 in the same or different support columns 32. The pressure in particular bladders 34 can be fine tuned for desired performance and/or comfort needs.

Tensile member 38 may be formed as a textile structure that includes a first wall 46, a second wall 48, and a plurality of connecting members 50 anchored to each of first wall 46 and second wall 48. First wall 46 is spaced away from second wall 48, and connecting members 50 extend between first wall 46 and second wall 48 to retain a substantially constant spacing between walls 46 and 48. First wall 46 is bonded to first barrier layer 40, and second wall 48 is bonded to second barrier layer 42. In this configuration, the pressurized fluid within the chamber formed by barrier 36 places an outward force upon barrier layers 40 and 42 and tends to move barrier layers 40 and 42 apart. The outward force supplied by the pressurized fluid, however, extends connecting members 50 and places connecting members 50 in tension, which restrains further outward movement of barrier layers 40 and 42. Accordingly, tensile member 38 is bonded to the interior surfaces of bladder 34 and limits the degree to which barrier layers 40 and 42 may move apart upon pressurization of bladder 34

Figure 6:
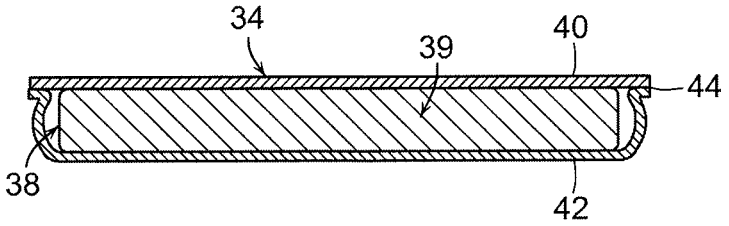
FIG. 6 is a sectional view of an alternative embodiment of a fluid-filled bladder of the article of footwear of FIG. 1.
Figure 7:
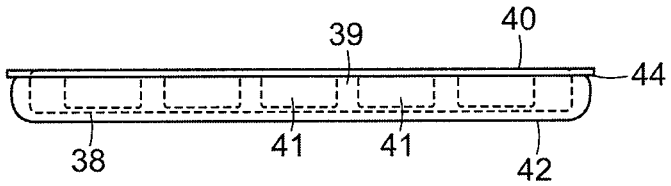
FIG. 7 is a sectional view of an alternative embodiment of the fluid-filled bladder of FIG. 6.

In other embodiments, tensile member 38 may be formed of a foam element 39 that is positioned between and bonded to first barrier layer 40 and second barrier layer 42, as illustrated in FIG. 6 which limits the degree to which barrier layers 40 and 42 may move apart upon pressurization. In certain embodiments, as illustrated in FIG. 7, foam element 39 may include a plurality of chambers 41 extending therethrough.

Exemplary tensile members made of foam elements are described in U.S. Pat. No. 7,131,218; U.S. Patent Publication No. 2005/0167029; and U.S. Patent Publication No. 2007/0063368, each of which is incorporated herein by reference in their entirety for all purposes.

A variety of techniques may be utilized to bond tensile member 38 to each of first barrier layer 40 and second barrier layer 42. For example, a layer of thermally activated fusing agent may be applied to first wall 46 and second wall 48. The fusing agent may be a sheet of thermoplastic material, such as thermoplastic polyurethane, that is heated and pressed into contact with first wall 46 and second wall 48 prior to placing tensile member 38 between barrier layers 40 and 42. The various elements of bladder 34 are then heated and compressed such that the fusing agent bonds with barrier layers 40 and 42, thereby bonding tensile member 38 to barrier 38. Alternately, a plurality of fusing filaments may be integrated into first wall 46 and second wall 48. The fusing filaments are formed of a material that will fuse, bond, or otherwise become secured to barrier layers 40 and 42 when the various components of bladder 34 are heated and compressed together. Suitable materials for the fusing filaments include, therefore, thermoplastic polyurethane or any of the materials that are discussed above as being suitable for barrier layers 40 and 42. The fusing filaments may be woven or otherwise mechanically manipulated into walls 46 and 48 during the manufacturing process for tensile element 38, or the fusing filaments may be subsequently incorporated into walls 46 and 48.

Figure 4:
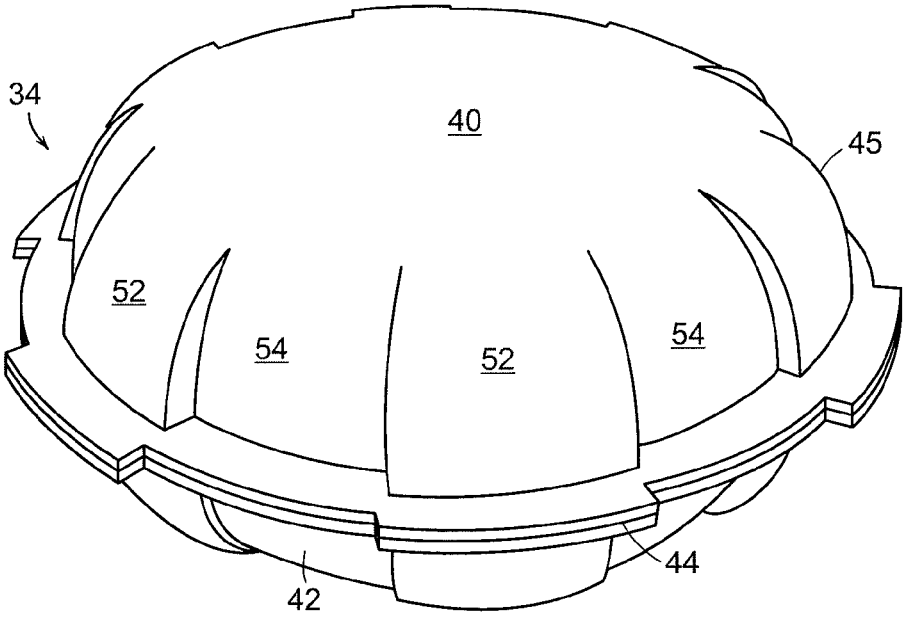
FIG. 4 is a perspective view of an alternative embodiment of a fluid-filled bladder for use in support columns of the article of footwear of FIG. 1.
Figure 5:
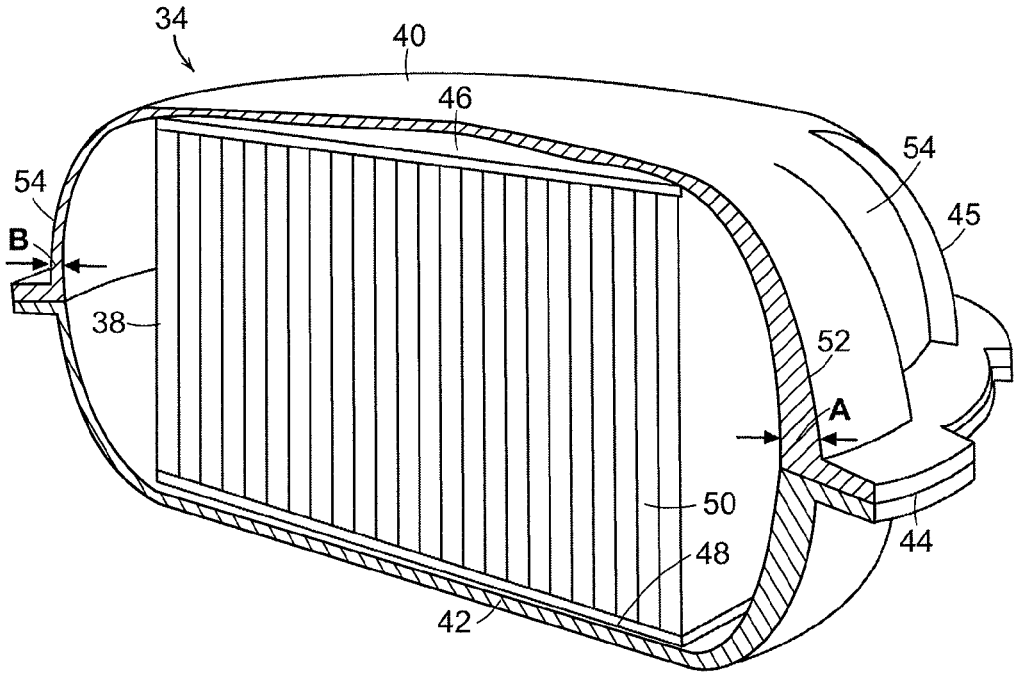
FIG. 5 is a section view of the fluid-filled bladder of FIG. 4.

In certain embodiments, as seen in FIGS. 4-5, sidewall 45 may be formed of a plurality of panels. In the illustrated embodiment, sidewall 45 is formed of a plurality of first panels 52 and a plurality of second panels, with first and second panels 52, 54 alternating about the periphery of bladder 34. First panels 52 have a first thickness A, while second panels 54 have a second thickness B. First thickness A is greater than, or thicker than, thickness B. Thus, it can be seen in FIGS. 4-5 that sidewall 45 has a thickness about its periphery that alternates between a thicker portion, a thinner portion, a thicker portion, a thinner portion, etc.

By providing alternating bands of thicker and thinner wall thicknesses, bladder 34 is provided with both extra strength from the thicker first panels 52, and flexibility from the thinner second panels 54. Consequently, bladder 34 can stretch and flex like a cage, however, it still retains the necessary strength to provide a robust support structure for footwear 10. Bladder 34 advantageously is produced with a fewer number of parts, thereby increasing manufacturing efficiencies. Additionally, bladder 34 provides abrasion resistance to protect from potential failure.

In certain embodiments, as illustrated in FIGS. 4-5, first panels 52 and second panels 54 each have a thickness that varies from a maximum thickness at its central portion, at peripheral bond 44, to a reduced thickness at its upper and lower boundaries, that is, where sidewall 45 joins first boundary layer 40 and second boundary layer 42, respectively.

Figure 8:
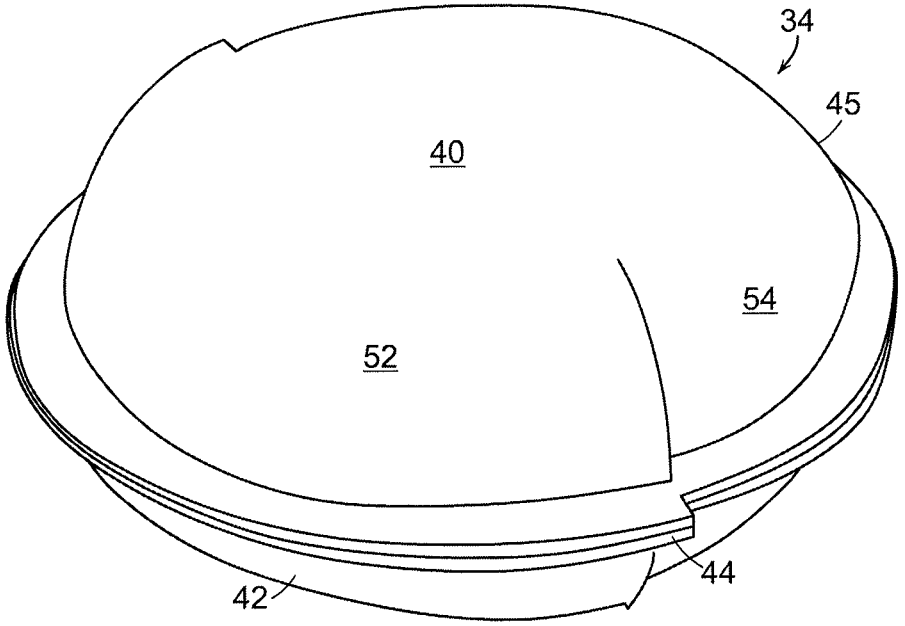
FIG. 8 is a perspective view of another alternative embodiment of a fluid-filled bladder for use in support columns of the article of footwear of FIG. 1.

In certain embodiments, bladder 34 may have an asymmetric construction, as illustrated in FIG. 8. In this embodiment, bladder 34 is formed with a single first panel 52 and a single second panel 54, which is thinner than first panel 52. In such an embodiment, the thicker portion of bladder 34, that is, the portion including first panel 52 may be positioned at an exterior position of support assembly 14 with the thinner portion including second panel 54 being positioned at an interior position of support assembly 14. It is to be appreciated that bladder 34 can have any number of first panels 52 and second panels 54, in any desired arrangement. Further, it is to be appreciated that one or more additional panels with thicknesses different than that of first panel 52 and second panel 54 may be provided about bladder 34. Consequently, the performance of footwear 10 can be adjusted and optimized by positioning panels of desired thicknesses at select locations about bladder 34.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising, in combination:
an upper; and
a sole assembly secured to the upper and comprising:
a top plate extending from a medial side of the upper to a lateral side of the upper;
a bottom plate positioned below the top plate and extending from the medial side of the upper to the lateral side of the upper; and
a plurality of support columns extending between the top plate and the bottom plate, each support column formed of a plurality of fluid-filled bladders, each bladder having a first surface, an opposed second surface, and a tensile member joined to the first and second surfaces;
wherein each bladder includes a sidewall joining the first surface to the second surface, the sidewall of at least one bladder being formed of a plurality of first panels having a first thickness and a plurality of second panels having a second thickness that is different from the first thickness, the thickness of each panel varying from a maximum thickness at its central portion to reduced thickness portions where the sidewall joins the first and second surfaces, the first and second panels abutting one another and alternating about a periphery of the bladder such that the sidewall has a thickness about the periphery that alternates sequentially between thicker portions and thinner portions abutting the thicker portions.

2. The article of footwear of claim 1, wherein each support column includes two fluid-filled bladders stacked upon one another.

3. The article of footwear of claim 1, wherein the bottom plate extends rearwardly from a midfoot portion of the sole assembly.

4. The article of footwear of claim 1, further comprising an outsole secured to a lower surface of the bottom plate.

5. The article of footwear of claim 1, wherein the sole assembly includes four support columns.

6. The article of footwear of claim 1, wherein the sole assembly includes:
a first support column positioned in a lateral rear portion of a heel portion of the sole assembly;
a second support column positioned in a medial rear portion of the heel portion of the sole assembly;

a third support column positioned in a medial forward portion of the heel portion of the sole assembly; and a fourth support column positioned in a lateral forward portion of the heel portion of the sole assembly.

7. The article of footwear of claim 1, wherein the tensile member is formed from a textile material.

8. The article of footwear of claim 1, wherein the tensile member is formed from a textile material that includes a first wall bonded to the first surface, a second wall bonded to the second surface, and a plurality of connecting members extending between the first wall and the second wall.

9. The article of footwear of claim 1, wherein the bladder encloses a pressurized fluid.

10. The article of footwear of claim 1, further comprising a midsole positioned between the upper and the top plate.

11. The article of footwear of claim 10, further comprising an outsole secured to at least one of a lower surface of the bottom plate and the midsole.

12. The article of footwear of claim 1, wherein the tensile member is a foam element.

13. The article of footwear of claim 12, further comprising a plurality of channels extending through the foam element.

14. An article of footwear comprising, in combination:

an upper; and a sole assembly secured to the upper and comprising:

a midsole;

an upper plate positioned below the midsole and extending from a medial side of the upper to a lateral side of the upper;

a lower plate positioned beneath the upper plate and extending from the medial side of the upper to the lateral side of the upper; and a plurality of support columns extending between the upper plate and the lower plate, each support column formed of a plurality of fluid-filled bladders, each bladder having a first surface, an opposed second surface, a sidewall joining the first surface to the second surface, the sidewall formed of a plurality of first panels having a first thickness and a plurality of second panels having a second thickness that is different from the first thickness, and a tensile member joined to the first and second surfaces, the tensile member comprising:

a first wall bonded to the first surface;

a second wall bonded to the second surface; and a plurality of connecting members extending between the first wall and the second wall;

wherein the thickness of each panel varies from a maximum thickness at its central portion to reduced thickness portions where the sidewall joins the first and second surfaces, the first and second panels abutting one another and alternating about a periphery of the bladder such that the sidewall has a thickness about the periphery that alternates sequentially between thicker portions and thinner portions abutting the thicker portions.

15. The article of footwear of claim 14, wherein the sole assembly includes four support columns.

16. The article of footwear of claim 14, wherein the sole assembly includes:

a first support column positioned beneath a lateral rear portion of a heel portion of the midsole;

a second support column positioned beneath a medial rear portion of the heel portion of the midsole;

a third support column positioned beneath a medial forward portion of the heel portion of the midsole; and a fourth support column positioned beneath a lateral forward portion of the heel portion of the midsole.

17. The article of footwear of claim 14 further comprising an outsole secured to at least one of the lower surface of the bottom plate and the midsole.

18. An article of footwear comprising, in combination:

an upper;

a sole assembly secured to the upper and comprising:

a midsole;

an upper plate positioned below the midsole and extending from a medial side of the upper to a lateral side of the upper;

a lower plate positioned beneath the upper plate and extending from the medial side of the upper to the lateral side of the upper; and a plurality of support columns extending between the upper plate and the midsole, each support column comprising;

a plurality of bladders filled with pressurized fluid, each bladder having a first surface, an opposed second surface;

a sidewall joining the first surface to the second surface, the sidewall formed of a plurality of first panels having a first thickness and a plurality of second panels having a second thickness that is different from the first thickness, the thickness of each panel varying from a maximum thickness at its central portion to reduced thickness portions where the sidewall joins the first and second surfaces, the first and second panels abutting one another and alternating about a periphery of the bladder such that the sidewall has a thickness about the periphery that alternates sequentially between thicker portions and thinner portions abutting the thicker portions; and a tensile member formed of a textile material and joined to the first and second surfaces, the tensile member comprising:

a first wall bonded to the first surface;

a second wall bonded to the second surface; and a plurality of connecting members extending between the first wall and the second wall; and an outsole secured to at least one of the bottom plate and the midsole.

* * * * *